US009039456B2

(12) United States Patent
Wang et al.

(10) Patent No.: US 9,039,456 B2
(45) Date of Patent: May 26, 2015

(54) ELECTRICAL CONNECTOR WITH FASTENING ELEMENTS

(71) Applicant: ALLTOP ELECTRONCS (SUZHOU) LTD., Taicang, JiangSu Province (CN)

(72) Inventors: Fei Wang, Shanghai (CN); Gang Jin, Shanghai (CN); Hung-Chi Tai, Jhonghe (TW); Yung-Chih Hung, Jhonghe (TW); Chieh-Yu Cheng, Jhonghe (TW)

(73) Assignee: ALLTOP ELECTRONICS (SHUZHOU) LTD., Taicang (CN)

( * ) Notice: Subject to any disclaimer, the term of this patent is extended or adjusted under 35 U.S.C. 154(b) by 72 days.

(21) Appl. No.: 14/024,389

(22) Filed: Sep. 11, 2013

(65) Prior Publication Data

US 2014/0378003 A1 Dec. 25, 2014

(30) Foreign Application Priority Data

Jun. 25, 2013 (CN) ..... 2013 1 0254105

(51) Int. Cl.
*H01R 24/00* (2011.01)
*H01R 24/76* (2011.01)

(52) U.S. Cl.
CPC ..... *H01R 24/76* (2013.01)

(58) Field of Classification Search
CPC ..... H01R 24/76
USPC ..... 439/78, 79, 660, 695, 737
See application file for complete search history.

(56) References Cited

U.S. PATENT DOCUMENTS

| | | | | |
|---|---|---|---|---|
| 3,544,952 | A * | 12/1970 | Piaget | 439/564 |
| 4,273,408 | A * | 6/1981 | Orr | 439/737 |
| 5,487,677 | A * | 1/1996 | Hoffner | 439/293 |
| 6,884,091 | B1 * | 4/2005 | Rigby et al. | 439/79 |
| 7,413,478 | B2 * | 8/2008 | Kleinschmidt et al. | 439/686 |

* cited by examiner

*Primary Examiner* — Khiem Nguyen
(74) *Attorney, Agent, or Firm* — Sughrue Mion, PLLC

(57) ABSTRACT

An electrical connector includes an insulative housing, at least one conductive contact, a limiting element and a fastening element. The insulative housing defines an upper first receiving passage and a lower second receiving passage spaced from the first receiving passage along an up-to-down direction by a horizontal first partition wall, and a first restriction section and a second restriction section. The at least one conductive contact is received in the first and second receiving passages, and partially received in the first restriction section and the second restriction section. The limiting element is received in the second restriction section. The fastening element is received in the second receiving passage and located below the limiting element to cooperate with the limiting element to fasten the at least one conductive contact with the insulative housing. The fastening element defines at least one contact-restriction section in at least on sidewall thereof.

14 Claims, 9 Drawing Sheets

ELECTRICAL CONNECTOR WITH FASTENING ELEMENTS

BACKGROUND OF THE INVENTION

1. Field of the Invention

The present invention relates to an electrical connector, more particularly to an electrical connector mounted on a Printed Circuit Board (PCB).

2. Description of Related Art

With the rapid development of the electronic technology, electrical connectors are widely used in electronic products for exchanging information or data etc. with peripheral devices. An electrical connector usually comprises an insulative housing, a plurality of contacts accommodated in the insulative housing, and a plurality of fastening elements for fixing the contacts to the insulative housing. Solder legs of the contacts protrude beyond the insulative hosing for being soldered to a Printed Circuit Board (PCB).

To satisfy the requirements of stable signal transmission and high transmission efficiency for the electric products, it is required to assure the stability of the electrical connectors. When assembling such a conventional electrical connector, usually the contacts are firstly assembled to the insulative housing, then the fastening elements fixing the contacts and the insulative housing. However, for preventing the fastening elements from escaping from the insulative housing, glue is usually applied to where the fastening elements assembled to, for achieving stable connection between the fastening elements and the insulative housing. But after the glue is dried, the fastening elements are still prone to escaping from the insulative housing, and the stability cannot be assured.

Hence, it is necessary to improve the conventional electrical connector to address problems mentioned above.

BRIEF SUMMARY OF THE INVENTION

Accordingly, an object of the present invention is to provide an electrical connector having fastening elements always connected with an insulative housing to achieve high stability.

In order to achieve the above-mentioned object, an electrical connector in accordance with the present invention comprises an insulative housing, at least one conductive contact received in the insulative housing, a limiting element and a fastening element. The insulative housing defines an upper first receiving passage and a lower second receiving passage spaced from the first receiving passage along an up-to-down direction by a horizontal first partition wall, and a first restriction section and a second restriction section respectively penetrating the first partition wall to communicate with the first receiving passage and the second receiving passage. The at least one conductive contact is received in the first and second receiving passages, and partially received in the first restriction section and the second restriction section. The limiting element is received in the second restriction section and extending from the first receiving passage to the second receiving passage. The fastening element is received in the second receiving passage and located below the limiting element to cooperate with the limiting element to fasten the at least one conductive contact with the insulative housing. The fastening element defines at least one contact-restriction section in at least one sidewall thereof through which the at least one conductive contact passing to limit the movement of the at least one conductive contact in at least one direction.

The foregoing has outlined rather broadly the features and technical advantages of the present invention in order that the detailed description of the invention that follows may be better understood. Additional features and advantages of the invention will be described hereinafter, which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
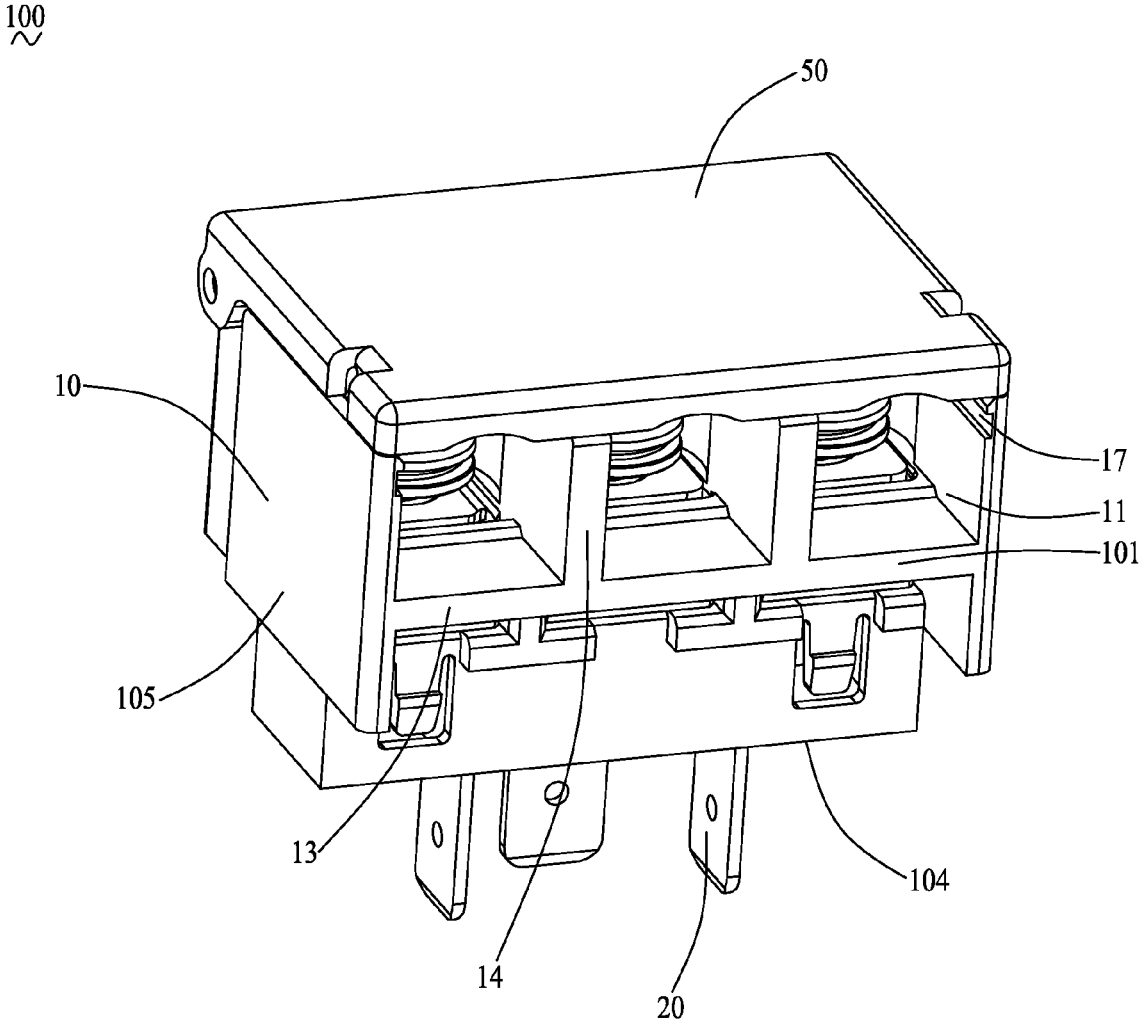
FIG. 1 is an assembled, perspective view of an electrical connector in accordance with the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
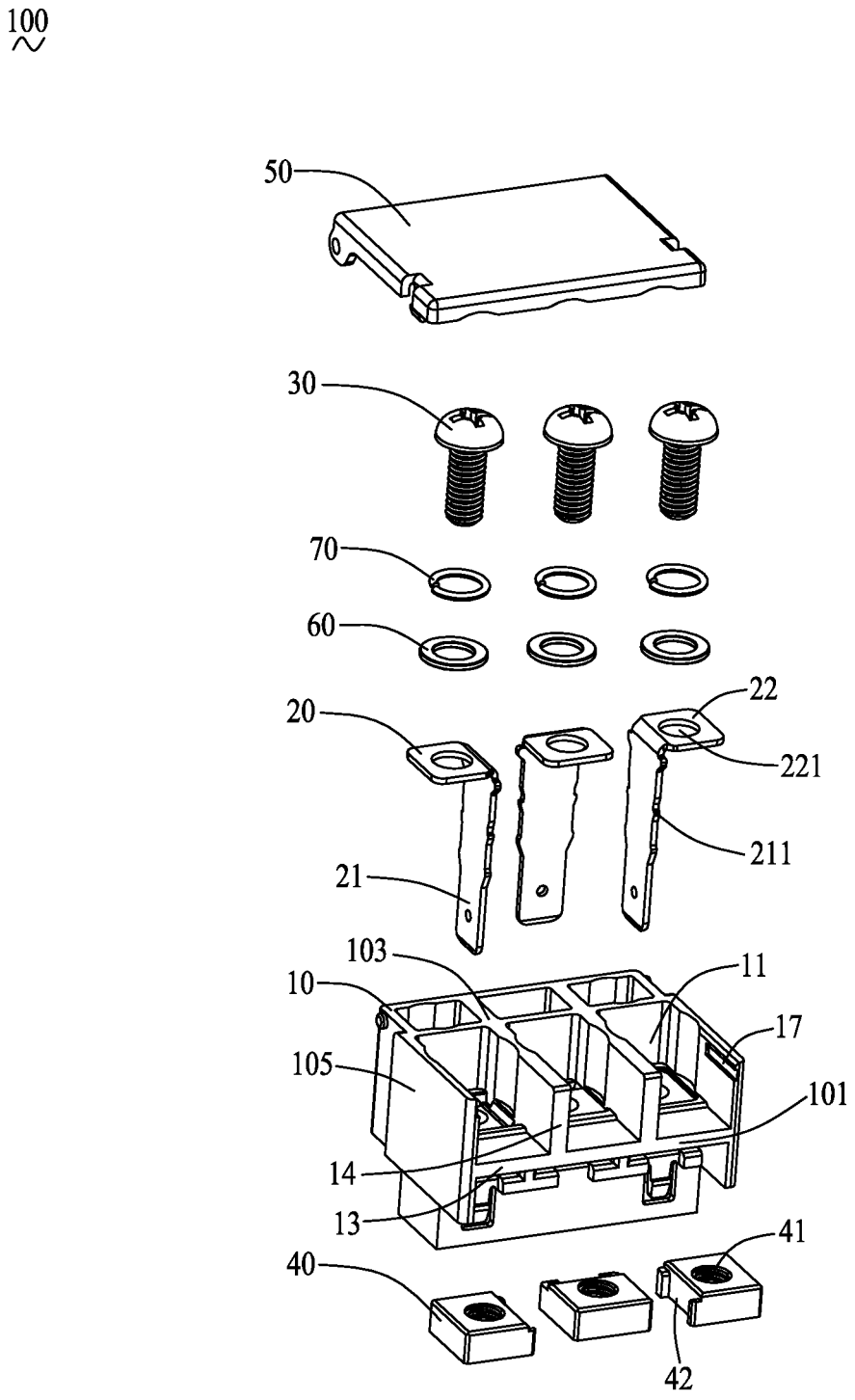
FIG. 2 is an exploded, perspective view of the electrical connector shown in FIG. 1.
Figure 3:
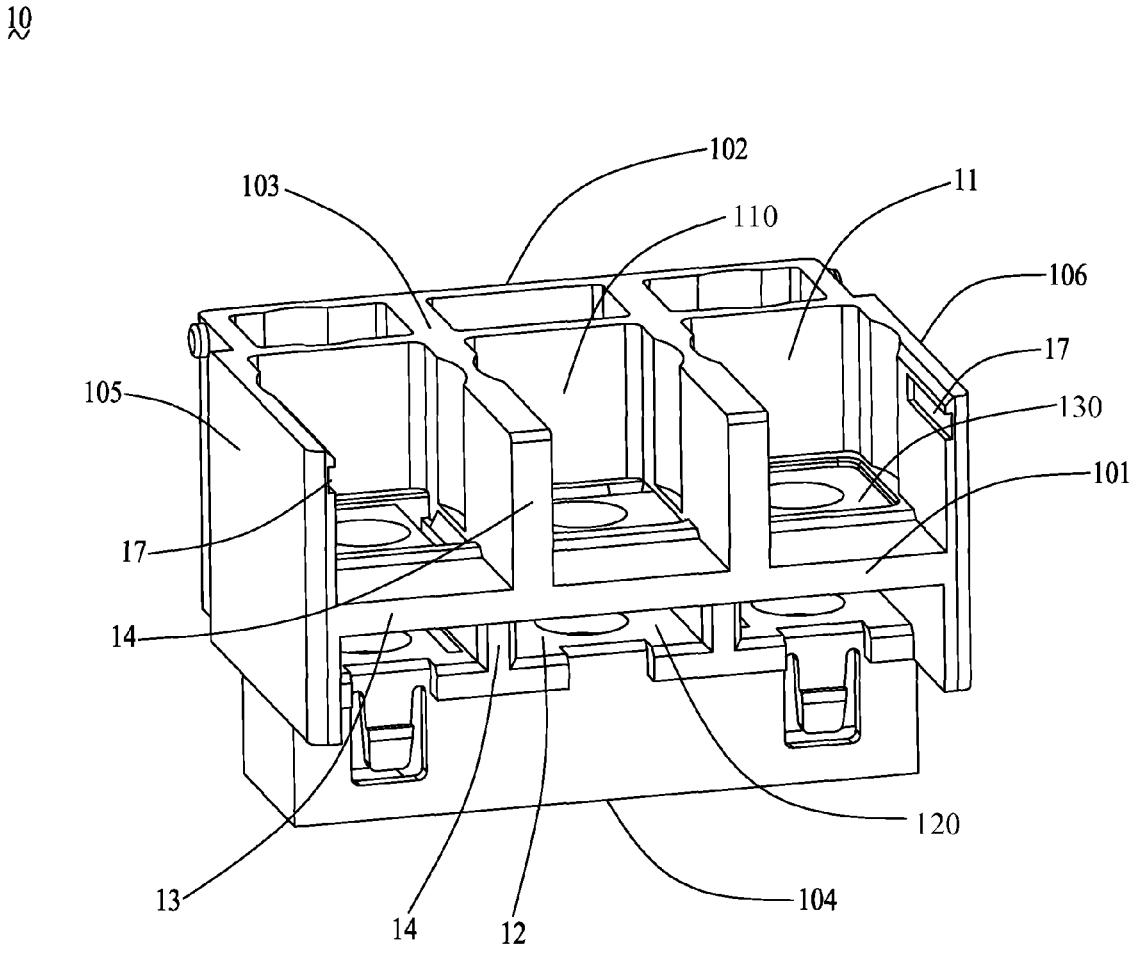
FIG. 3 is a perspective view of an insulative housing shown in FIG. 2.

Please refer to FIGS. 1-3, an electrical connector 100 in accordance with the present invention is used to be assembled to a Printed Circuit Board (PCB). The electrical connector 100 comprises an insulative housing 10, a plurality of conductive contacts 20 assembled in the insulative housing 10, a plurality of limiting elements 30, a plurality of fastening elements 40, and a cover 50 covering the insulative housing 10 and the conductive contacts 20.

Figure 4:
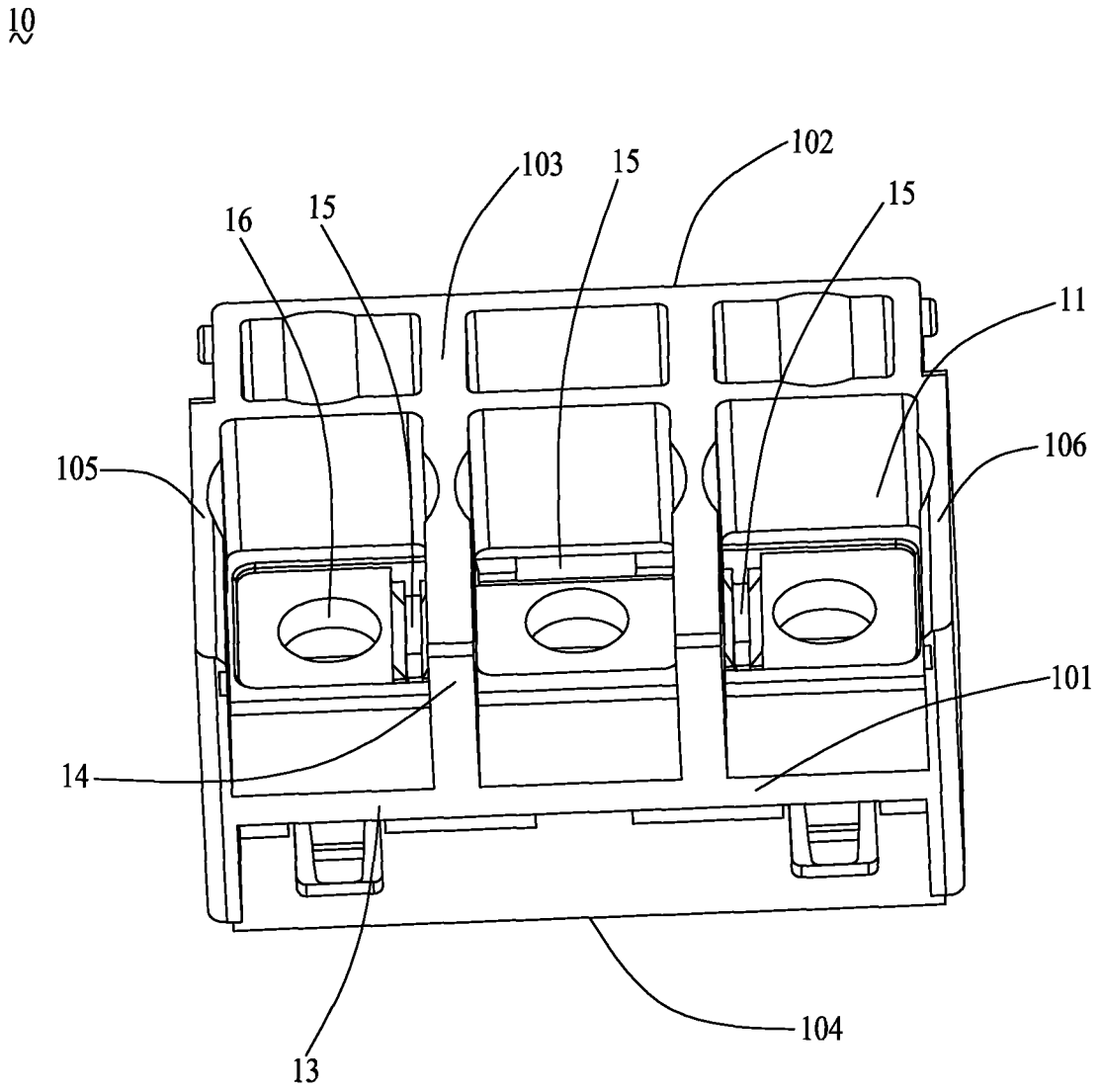
FIG. 4 is a view similar to FIG. 3, but from a different aspect.

Please refer to FIGS. 3-4, the insulative housing 10 comprises a front wall 101, a rear wall 102 opposite to the front wall 101, a top wall 103, a bottom wall 104 opposite to the top wall 103, opposite left wall 105 and right wall 106 connecting with the opposite front and rear walls 101, 102, and opposite top and bottom walls 103, 104. The front wall 101, the rear wall 102, the top wall 103, the bottom wall 104, the left wall 105 and the right wall 106 together circumscribe a first receiving space 11 and a second receiving space 12 spaced from the first receiving space 11 along an up-to-down direction.

The first and second receiving spaces 11, 12 are spaced by a pair of upper and lower horizontal first partition walls 13 which extend perpendicularly between the opposite left wall 105, and the right wall 106. The first receiving space 11 and the second receiving space 12 are respectively divided into three first receiving passages 110 and three second receiving passages 120 by a pair of vertical second partition walls 14 which are perpendicular to the first partition wall 13 and parallel to the opposite left wall 105 and the right wall 106. The first receiving passages 13 open in the front wall 101. The insulative housing 10 also defines three rectangular recesses 130 recessed downwardly a little from a top surface of the upper first partition wall 13.

The insulative housing 10 defines a plurality of narrow and substantially rectangular first restriction sections 15 and a plurality of round second restriction sections 16 respectively penetrating through the upper and lower horizontal first partition walls 13 and communicating with the recesses 130. The first and second restriction sections 15, 16 all communicate with both the first and second receiving passages 110, 120. In the preferred embodiment of the present invention, the left and right first restriction sections 15 are located adjacent to the second partition walls 14, while the middle restriction section 15 is located adjacent to the rear wall 102. However, in an alternative embodiment of the present invention, the location of the first restriction sections 15 could be in the same direction or different directions according to actual needs.

Each of the left wall 105 and the right wall 106 is defined with a rectangular sliding slot 17 extending rearward from the front wall 101.

Figure 5:
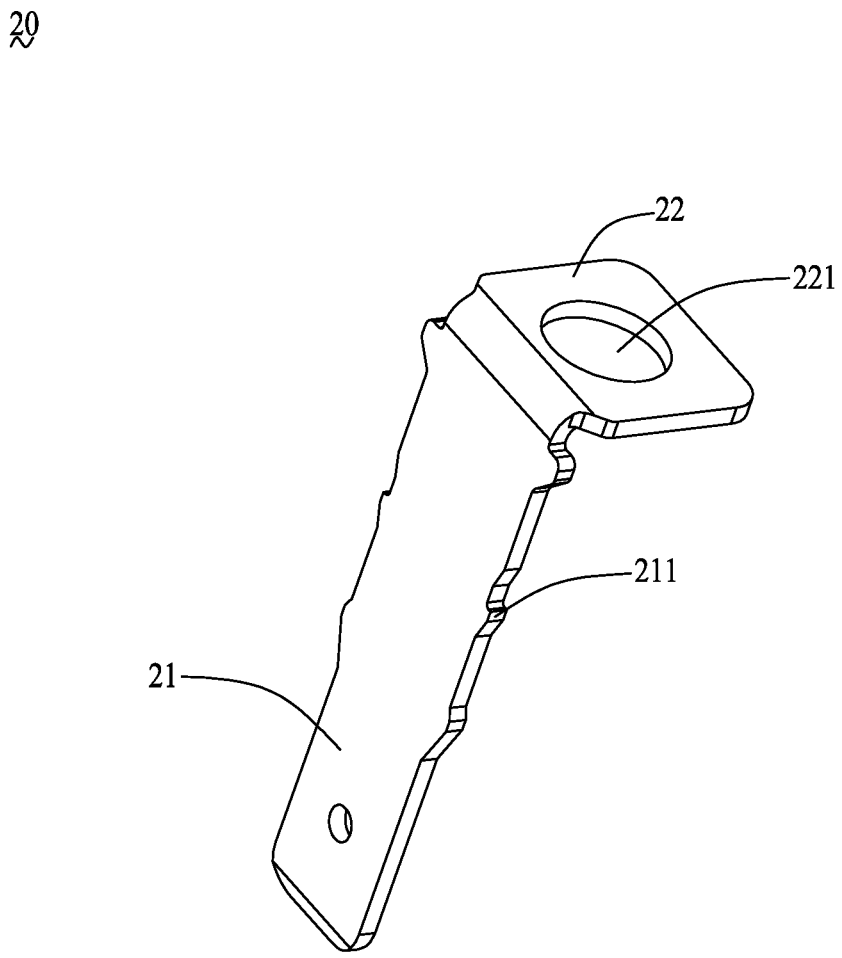
FIG. 5 is a perspective view of a conductive contact shown in FIG. 2.

Please refer to FIG. 5 in conjunction with FIGS. 3-4, the conductive contacts 20 are respectively received in the first and second receiving passages 110, 120 and penetrating through the first restriction sections 15. Each conductive contact 20 comprises a vertical flat contacting portion 21 penetrating through and partially received in the first restriction section 15 and exposed beyond the bottom surface 102 of the insulative housing 10, and a horizontal latching portion 22 bending vertically from a top end of the contacting portion 21, thus, the conduct contact 20 is of L-shape. The latching portion 22 is rectangular and received in the recess 130 and defines a round second positioning hole 221 aligning with the second restriction section 16. The contacting portion 21 is formed with a plurality of barbs 211 for interferentially engaging with the first restriction section 15 and the fastening elements 40. In the preferred embodiment of the present invention, the contacting portions 21 of the left and right conductive contacts 20 are parallel to each other with the pair of latching portions 22 bending in opposite first and second directions. The contacting portion 21 of the middle conductive contact 20 is arranged to be perpendicular to the contacting portions 22 of the left and right conductive contacts 20, with the latching portion 22 thereof bending toward a third direction perpendicular to the first and second directions.

In the preferred embodiment of the present invention, the limiting element 30 is a screw, and a screw cap (not labeled) thereof received in the first receiving passage 110 and pressing against the latching portion 22, with a screw rod (not labeled) thereof penetrating through the second restriction section 16 and protruding into the second receiving passage 120. In the preferred embodiment of the present invention, the fastening element 40 is a rectangular screw nut having four sidewalls 44 and received in the second receiving passage 120 and screwed with the screw 30 for fastening the conductive contact 20 with the insulative housing 10. The fastening element 40 defines a second positioning hole 41 which threaded and aligning with the second restriction section 16 and the first positioning hole 221 of the conductive contact 20, then screwed with the limiting element 30.

Please refer to FIGS. 2-4, the electrical connector 100 also comprises a set of protecting element, which comprises a gasket 60 and a spring ring 70 put on the latching portion 22 of the conductive contacts 20 in turn for further preventing the conductive contacts 20 and the fastening elements 40 from escaping from the insulative housing 10.

Figure 6:
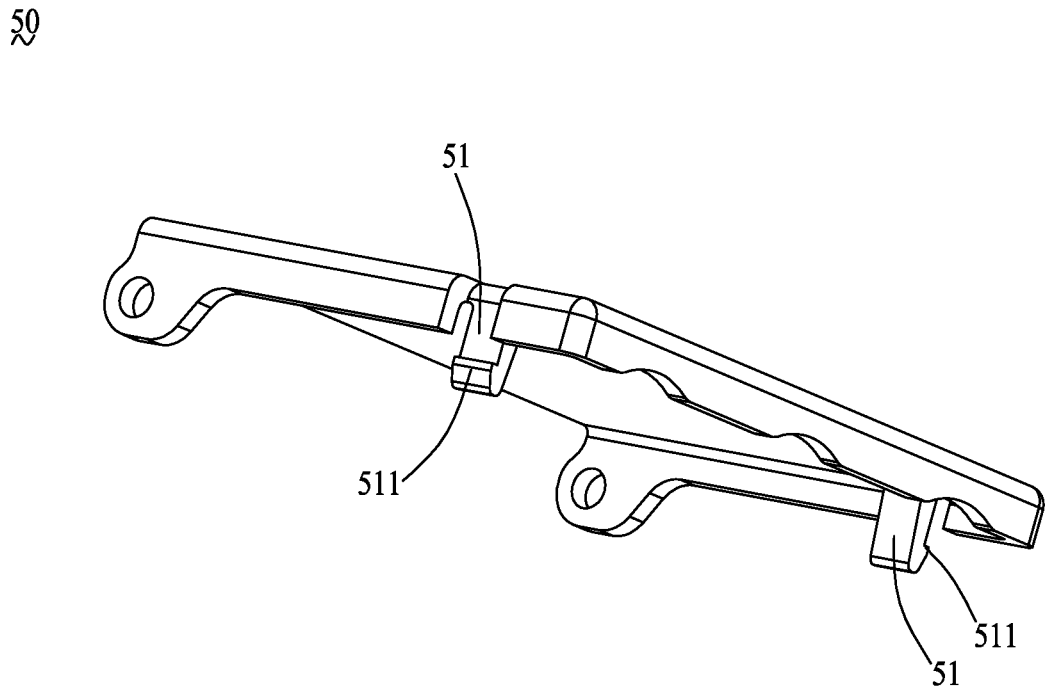
FIG. 6 is a perspective view of a cover shown in FIG. 2.

Please refer to FIG. 6 in conjunction with FIG. 3, the cover 50 forms a pair of elastic arms 51 extending downwardly from opposite sidewalls thereof which cooperate with the opposite left wall 105 and the right wall 106. Each elastic arm 51 forms a latch section 511 which latches into the sliding slot 17, thus, the cover 50 could latch with the insulative housing 10.

Figure 7:
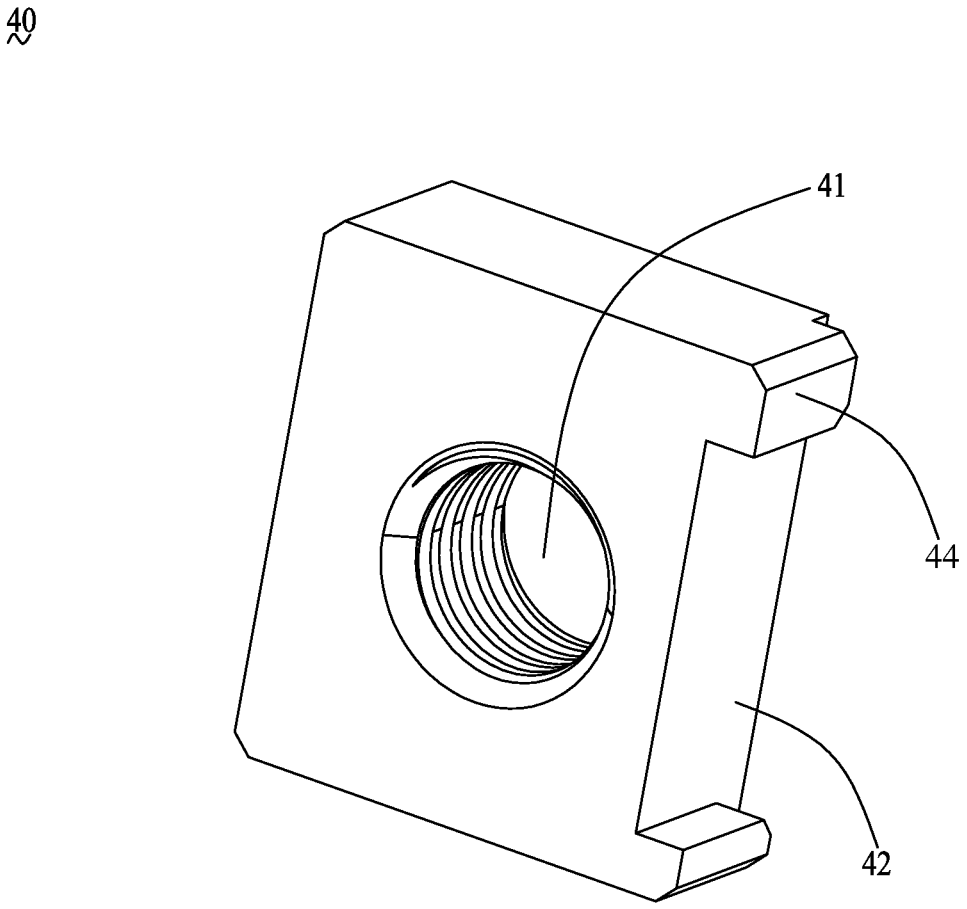
FIG. 7 is a perspective view of a fastening element in accordance with a first embodiment of the present invention.
Figure 8:
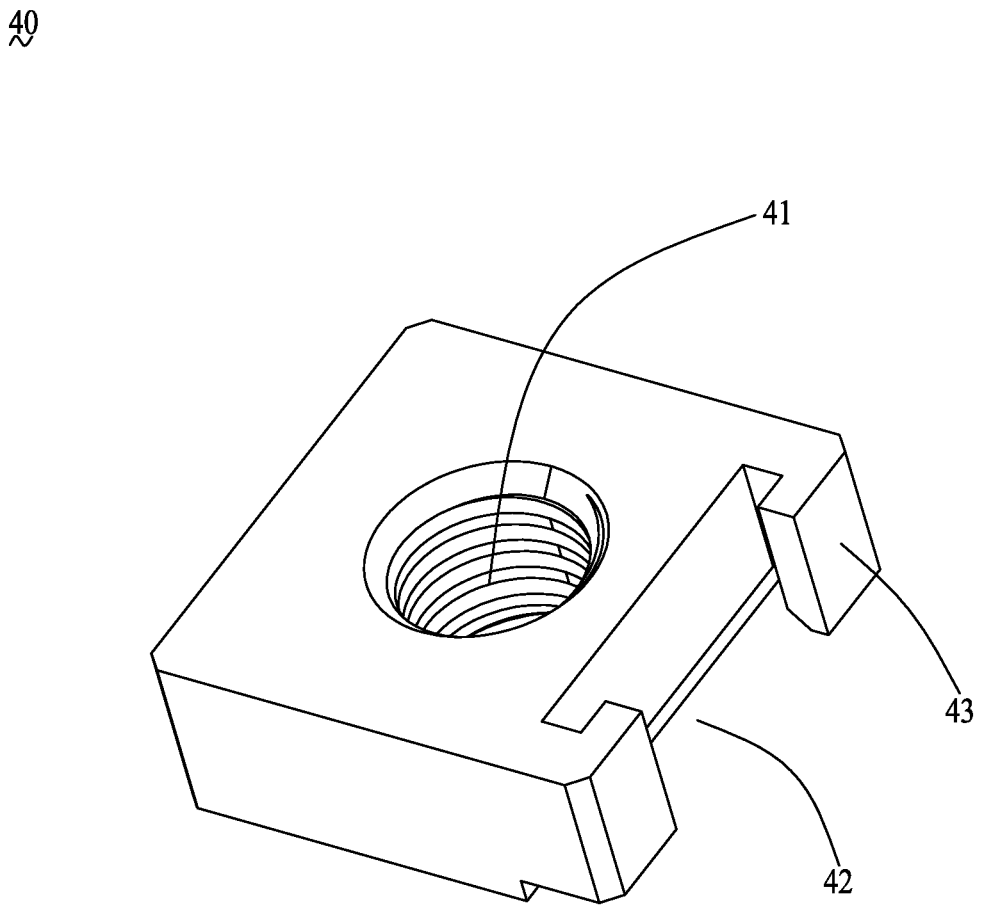
FIG. 8 is a perspective view of a fastening element in accordance with a second embodiment of the present invention.
Figure 9:
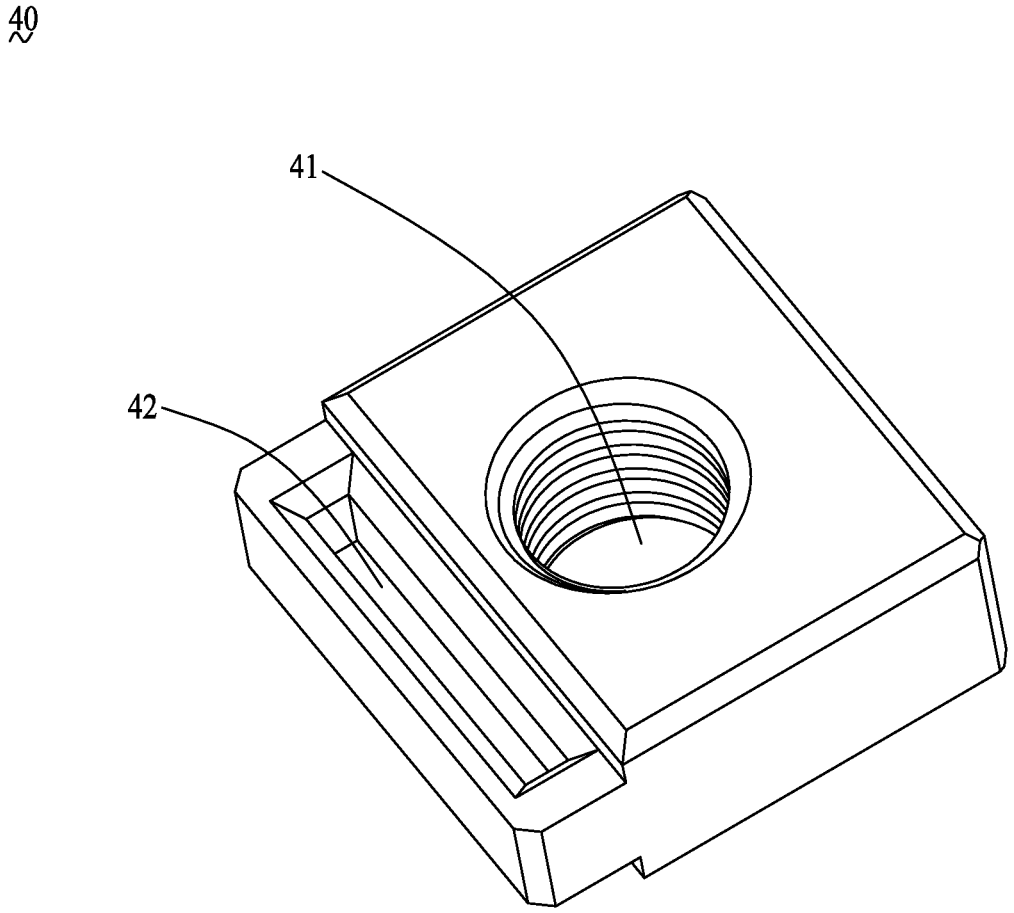
FIG. 9 is a perspective view of a fastening element in accordance with a third embodiment of the present invention.

FIGS. 7-9 show three embodiments of the fastening element 40. Except the first positioning hole 41 aligning with the second restriction section 16, the fastening element 40 also defines a contact-restriction section 42 recessed from one sidewall 44 of the fastening element 40 toward the other opposite sidewall 44 for the contacting portion 21 interferentially penetrating therethrough, thus, restricting the movement of the conductive contact 20 along a front-to-back direction or up-to-down direction. In FIG. 7, the contact-restriction section 42 is a cutout recessed from one sidewall 44 of the fastening element 40, and the length of the cutout 42 is less than that of the sidewall 44. Thus, the movement along the front-to-back direction of the contacting portion 21 of the conductive contact 20 could be restricted. In FIG. 8, the contact-restriction section 42 is also a cutout recessed from one sidewall 44 of the fastening element 40, a pair of restriction blocks 43 is formed on the sidewall 44 and extends toward each other a certain distance to make the contact-restriction section 42 T-shape. Thus, the movement in the front-to-back direction and the left-to-right direction of the contacting portion 21 of the conductive contact 20 is restricted. In FIG. 9, the contact-restriction section 42 is a closed rectangular loop to restrict the movement in the front-to-back direction and the left-to-right direction of the contacting portion 21 of the conductive contact 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical connector, comprising:

an insulative housing defining an upper first receiving passage and a lower second receiving passage spaced from the first receiving passage along an up-to-down direction by a horizontal first partition wall, and a first restriction section and a second restriction section respectively penetrating the first partition wall to communicate with the first receiving passage and the second receiving passage;

at least one conductive contact received in the first and second receiving passages, and partially received in the first restriction section and the second restriction section;

a limiting element received in the second restriction section and extending from the first receiving passage to the second receiving passage; and a fastening element received in the second receiving passage and located below the limiting element to cooperate with the limiting element to fasten the at least one conductive contact with the insulative housing, the fastening element defining at least one contact-restriction section in at least on sidewall thereof through which the at least one conductive contact passing to limit the movement of the at least one conductive contact in at least one direction.

2. The electrical connector as claimed in claim 1, wherein the contact-restriction section of the fastening element is a cutout recessed from a sidewall of the fastening element toward the other opposite sidewall, and wherein the length of the cutout is less than that of the sidewall of the fastening element.

3. The electrical connector as claimed in claim 1, wherein the contact-restriction section of the fastening element is a cutout recessed from a sidewall of the fastening element toward the other opposite sidewall, the length of the cutout is less than that of the sidewall of the fastening element, and wherein a pair of restriction blocks is formed at opposite sides of the cutout and extends toward each other.

4. The electrical connector as claimed in claim 1, wherein the contact-restriction section of the fastening element is a rectangular recess defined near to the sidewall.

5. The electrical connector as claimed in claim 1, wherein the conductive contact is L-shape and comprises a horizontal latching portion positioned between the limiting element and the first partition wall, and a vertical contacting portion penetrating through the first restriction section, and extending into the second receiving passage and further extending beyond the insulative housing.

6. The electrical connector as claimed in claim 5, wherein the contacting portion forms a plurality of barbs interferentially engaging with the first restriction section and the fastening element.

7. The electrical connector as claimed in claim 5, wherein the fastening element defines a first positioning hole, the latching portion of the conductive contact defines a second positioning hole aligning with the first positioning hole, and wherein limiting element penetrates the first and second positioning holes and the second restriction section to fasten with the fastening element.

8. The electrical connector as claimed in claim 1, wherein the limiting element is a screw, and wherein the fastening element is a screw nut screwed with the screw to fasten the conductive contact to the insulative housing.

9. The electrical connector as claimed in claim 1, further comprising a gasket and a spring ring put between the limiting element and the conductive contact.

10. The electrical connector as claimed in claim 1, further comprising a cover covering the insulative housing and the conductive contact.

11. The electrical connector as claimed in claim 10, wherein the cover forms at least a pair of latch arms, and wherein the insulative housing comprises opposite left wall and right wall, and wherein the latch arms of the cover latches with the left wall and the right wall of the insulative housing.

12. The electrical connector as claimed in claim 11, wherein each of the left wall and the right wall defines a sliding slot, and wherein the latch arm of the cover forms a latch section latching in the sliding slot.

13. The electrical connector as claimed in claim 5, wherein the at least one conductive contact comprises three conductive contacts, and wherein the latching portions of the conductive contacts bending from corresponding contacting portions in three different directions, and the contacting portions of the left and right conductive contacts are parallel to each other, while the contacting portion of the middle conductive contact is perpendicular to the contacting portions of the left and right conductive contacts.

14. The electrical connector as claimed in claim 13, wherein the insulative housing defines three first receiving passages and three second receiving passages divided by a pair of second partition walls perpendicular to the first partition wall.

* * * * *